US009931003B2

(12) United States Patent
Sueyoshi et al.

(10) Patent No.: US 9,931,003 B2
(45) Date of Patent: Apr. 3, 2018

(54) BEAUTY DEVICE, BODY OF BEAUTY DEVICE, AND HEAD OF BEAUTY DEVICE

(71) Applicant: PANASONIC INTELLECTUAL PROPERTY MANAGEMENT CO., LTD., Osaka (JP)

(72) Inventors: Hidekazu Sueyoshi, Shiga (JP); Kazuyasu Ikadai, Shiga (JP); Kenichi Muraki, Shiga (JP); Tetsuro Hashiguchi, Shiga (JP); Natsumi Hashimoto, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 178 days.

(21) Appl. No.: 14/977,459

(22) Filed: Dec. 21, 2015

(65) Prior Publication Data

US 2016/0183743 A1 Jun. 30, 2016

(30) Foreign Application Priority Data

Dec. 25, 2014 (JP) ..... 2014-263067

(51) Int. Cl.
*B05B 3/02* (2006.01)
*A47K 7/04* (2006.01)
(Continued)

(52) U.S. Cl.
CPC ..... *A47K 7/04* (2013.01); *A47K 5/1201* (2013.01); *A47K 5/16* (2013.01); *A61H 7/005* (2013.01);
(Continued)

(58) Field of Classification Search
CPC ..... A47K 7/04; A47K 5/1201; A47K 5/16; A61H 7/005; A61H 35/008;
(Continued)

(56) References Cited

U.S. PATENT DOCUMENTS 5,143,295 A * 9/1992 Okayama ..... B05B 1/34 239/403
7,578,808 B2 * 8/2009 Fujisato ..... A01K 13/001 604/289
(Continued)

FOREIGN PATENT DOCUMENTS

EP 1972317 9/2008
EP 2873452 5/2015
(Continued)

OTHER PUBLICATIONS

The Extended European Search Report dated Jun. 10, 2016 for the related European Patent Application No. 15197407.8.

*Primary Examiner* — Steven J Ganey
(74) *Attorney, Agent, or Firm* — McDermott Will & Emery LLP

(57) ABSTRACT

A first head of a beauty device includes a stirring mechanism stirring bubbles, and a head case provided with an opening for allowing the bubbles stirred by the stirring mechanism to pass through. When the first head is used while being mounted to the body of the beauty device, bubbles are supplied to the stirring mechanism from the body of the beauty device. In a state where bubbles supplied to the stirring mechanism are present between the stirring mechanism and the skin, the bubbles are stirred and moved between the stirring mechanism and the skin by the stirring mechanism, and thus impurities of the skin are removed by the bubbles.

8 Claims, 13 Drawing Sheets

(51) Int. Cl.

| | |
|---|---|
| ***A61H 7/00*** | (2006.01) |
| ***B01F 7/00*** | (2006.01) |
| ***B01F 13/00*** | (2006.01) |
| ***B01F 3/04*** | (2006.01) |
| ***A61H 35/00*** | (2006.01) |
| ***A47K 5/12*** | (2006.01) |
| ***A47K 5/16*** | (2006.01) |
| *A61H 33/04* | (2006.01) |

(52) U.S. Cl.
CPC ..... *A61H 35/008* (2013.01); *B01F 3/04453* (2013.01); *B01F 7/00891* (2013.01); *B01F 13/002* (2013.01); *B05B 3/02* (2013.01); *A61H 2033/043* (2013.01); *A61H 2201/0207* (2013.01); *A61H 2201/0235* (2013.01); *A61H 2201/105* (2013.01); *A61H 2201/1418* (2013.01); *A61H 2201/1463* (2013.01); *A61H 2201/1604* (2013.01); *A61H 2201/1654* (2013.01); *A61H 2201/1685* (2013.01); *A61H 2201/5033* (2013.01); *A61H 2205/022* (2013.01)

(58) Field of Classification Search
CPC .. B01F 3/04453; B01F 7/0089; B01F 13/002; B05B 3/02; B05B 7/2408; B05B 15/065
USPC ..... 239/214, 214.25, 225.1, 263.1, 263.3, 239/302, 380, 390; 604/289
See application file for complete search history.

(56) References Cited

U.S. PATENT DOCUMENTS

| | | | | |
|---|---|---|---|---|
| 9,421,146 | B2 * | 8/2016 | Muraki ..... | A61H 7/005 |
| 2007/0293794 | A1 | 12/2007 | Siegrest et al. | |
| 2013/0023806 | A1 | 1/2013 | Ungemach et al. | |

FOREIGN PATENT DOCUMENTS

| | | | |
|---|---|---|---|
| JP | 2007-007008 | A | 1/2007 |
| JP | 2008-296965 | A | 12/2008 |
| JP | 2014-520646 | A | 8/2014 |
| WO | 2013/014594 | A2 | 1/2013 |

* cited by examiner

BEAUTY DEVICE, BODY OF BEAUTY DEVICE, AND HEAD OF BEAUTY DEVICE

RELATED APPLICATIONS

This application claims the benefit of Japanese Application No. 2014-263067, filed on Dec. 25, 2014, the disclosure of which Application is incorporated by reference herein.

BACKGROUND OF THE INVENTION

1. Field of the Invention

This disclosure relates to a beauty device, a body of the beauty device, and a head of the beauty device.

2. Description of the Related Art

A discharge container disclosed in Patent Document 1 (Japanese Patent Unexamined Publication No. 2008-296965) includes a container accommodating a liquid foaming agent, and a brush mounted to the container. In the discharge container, the foaming agent stored in the container is mixed with air, and the foaming agent mixed with air passes through a mesh body. Accordingly, bubbles are generated. The generated bubbles are supplied to the brush.

SUMMARY OF THE INVENTION

For example, the discharge container is deemed to be used to clean the skin. In this case, the brush to which the bubbles are supplied is brought into contact with the skin, and the brush is moved relative to the skin such that impurities are removed from the skin. However, when a user strongly presses the brush against the skin, strong irritation is likely to be applied to the skin.

An object of this disclosure is to provide a beauty device, a body of the beauty device, and a head of the beauty device which have a function of cleaning the skin, and are unlikely to apply strong irritation to the skin.

The head of the beauty device in an exemplary embodiment of this disclosure includes a stirring mechanism for stirring bubbles, and a head case provided with an opening for allowing the bubbles stirred by the stirring mechanism to pass through.

This exemplary embodiment has a function of cleaning the skin, and is unlikely to apply strong irritation to the skin.

DETAILED DESCRIPTION OF THE PREFERRED EMBODIMENTS

Figure 1:
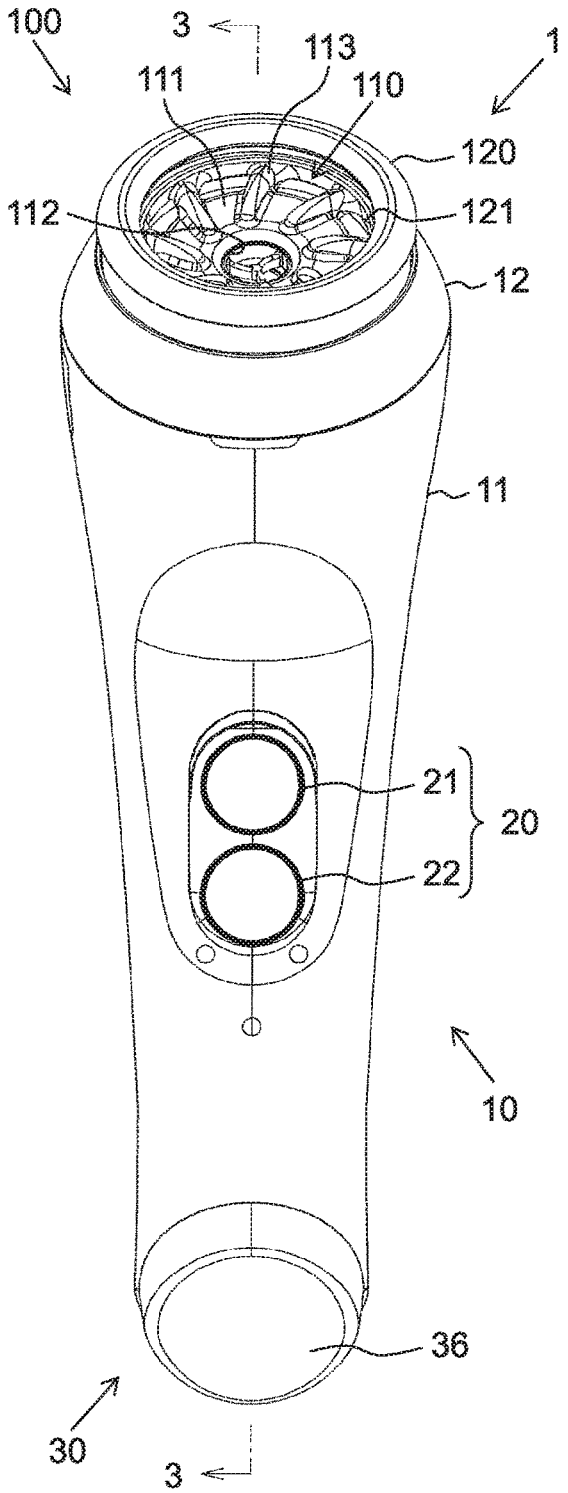
FIG. 1 is a front view of a beauty device in an exemplary embodiment.

Exemplary Embodiment of Beauty Device, Head of Beauty Device, and Body of Beauty Device

[1] According to an aspect of this disclosure, there is provided a head of a beauty device including a stirring mechanism configured to stir bubbles; and a head case provided with an opening for allowing the bubbles stirred by the stirring mechanism to pass through.

When the head of the beauty device is used while being attached to a body of beauty device, bubbles are supplied to the stirring mechanism from the body of the beauty device. In a state where bubbles supplied to the stirring mechanism are present between the stirring mechanism and the skin, the bubbles are stirred and moved between the stirring mechanism and the skin by the stirring mechanism. Accordingly, impurities of the skin are removed by the bubbles. In the head of the beauty device, the movement of bubbles formed by the stirring mechanism contributes to the removal of impurities from the skin. Therefore, it is unlikely that strong irritation is applied to the skin, compared to a method of removing impurities by strongly pressing brushes against the skin.

[2] In an example of the head of the beauty device, the head case includes a support portion configured to support the stirring mechanism in such a way that the stirring mechanism is capable of making at least one motion of a rotation and a movement relative to the head case.

In the head of the beauty device, when the stirring mechanism takes at least one motion of a rotation and a movement relative to the head case, bubbles are stirred. Therefore, the stirring mechanism is likely to homogeneously stir bubbles compared to when bubbles are stirred by the flow of air.

[3] In an example of the head of the beauty device, the head case includes a limiting portion configured to limit the position of the stirring mechanism in such a way that the stirring mechanism is not allowed to protrude out of the opening.

In the head of the beauty device, when the head case is brought into contact with the skin while the opening faces the skin, the stirring mechanism is further separated from the skin than a contact surface between the head case and the skin. Therefore, the stirring mechanism is unlikely to come into contact with the skin. As a result, the stirring mechanism is less likely to apply irritation to the skin.

[4] In an example of the head of the beauty device, the support portion supports the stirring mechanism in such a way that the stirring mechanism is capable of rotating relative to the head case. The stirring mechanism includes a base provided with a discharge port through which a mixture of a foaming agent and water passes, and a blade formed on a surface of the base which is an opening-side surface.

When the head of the beauty device is used while being attached to a body of beauty device, bubbles are supplied to a surface side of the base through the discharge port of the base while the bubbles are an example of a mixture of the foaming agent and water supplied to the stirring mechanism from the body of the beauty device. The bubbles present on the surface side of the base are stirred by the blade. Therefore, the bubbles supplied to the stirring mechanism are likely to be homogeneously stirred.

[5] In an example of the head of the beauty device, the discharge port is formed in a center portion of the base. A plurality of the blades are formed in a radial pattern around the discharge port.

In the head of the beauty device, bubbles are supplied to the surface side of the base from the discharge port formed in in the center portion of the base, and thus it is easy to equally supply bubbles to regions on the surface side of the base. The bubbles supplied to the surface side of the base are stirred by the plurality of blades which are formed in a radial pattern. Therefore, the bubbles are more likely to be homogeneously stirred.

[6] In an example of the head of the beauty device, a return port is formed in an outer circumferential portion of the base, and passes through the stirring mechanism.

Bubbles may be generated in a state where the foaming agent is not sufficiently mixed with water. The bubbles are heavy compared to bubbles which are generated when the foaming agent is sufficiently mixed with water. In the head of the beauty device, when the heavy bubbles are supplied to the surface side of the stirring mechanism, the bubbles flow to a back surface side of the stirring mechanism through the return ports due to centrifugal force induced by the rotation of the stirring mechanism. As a result, it is unlikely that heavy bubbles are accumulated on the surface of the stirring mechanism. Even if liquid is generated due to insufficient mixing of the foaming agent with water, and the liquid is supplied to the surface side of the stirring mechanism, it is possible to obtain the same effects.

[7] In an example of the head of the beauty device, the support portion supports the stirring mechanism in such a way that the stirring mechanism is capable of moving relative to the head case in a direction of approaching the opening, and another direction of moving away from the opening.

In the head of the beauty device, when the stirring mechanism moves relative to the head case, bubbles supplied to the surface side of the stirring mechanism are stirred. Therefore, the bubbles are moved between the stirring mechanism and the skin, and thus impurities are removed from the skin.

[8] As an example, the head of the beauty device further includes an elastic member configured to press the stirring mechanism in the direction of moving the stirring mechanism away from the opening.

In the head of beauty device, even if a large amount of bubbles stay on the back surface side of the stirring mechanism, it is unlikely that the stirring mechanism is prevented from moving relative to the head case. As a result, a bubble stirring function of the stirring mechanism is less likely to deteriorate.

[9] According to another aspect of this disclosure, there is provided a body of a beauty device including: a head mount unit which a first head, which is the head according to [1] to [8], and a second head having a structure different from that of the first head can be attached to and detached from; a drive source configured to apply torque to the first head or the second head; a first transmission mechanism configured to transmit torque to the first head; and a second transmission mechanism configured to transmit torque to the second head. A rotational speed transmitted to the first head by the first transmission mechanism is higher than a rotation speed transmitted to the second head by the second transmission mechanism.

When the first head is mounted to the body of the beauty device, torque of the drive source is transmitted to the first head via the first transmission mechanism such that the stirring mechanism operates. Instead of the first head, the second head can be mounted to the body of the beauty device. When the second head is mounted to the body of the beauty device, torque of the drive source is transmitted to the second head via the second transmission mechanism such that functional components of the second head rotate at a rotational speed lower than that of the stirring mechanism. Since the stirring mechanism of the first head rotates at a speed higher than that of the functional components of the second head, bubbles supplied to the stirring mechanism are more reliably stirred compared to when a relationship in the rotational speed is set differently from the aforementioned relationship.

[10] According to still another aspect of this disclosure, there is provided a beauty device including: the head according to [1] to [8]; and a body including a head mount unit which the head can be attached to and detached from, and a drive source configured to output a drive force for driving the head.

According to the beauty device, it is possible to obtain substantially the same effects as those obtained according to the examples described in [1] to [8].

[11] As an example of the beauty device, the body comprises the body according to [9].

According to the beauty device, it is possible to obtain substantially the same effects as those obtained according to the examples described in [1] to [9].

Exemplary Embodiment

FIG. 1 illustrates an exterior of handheld beauty device 1 used mainly to clean the face. Beauty device 1 includes body 10 including various elements of beauty device 1, and a plurality of heads attachable to and detachable from body 10. Examples of the plurality of heads include first head 100 illustrated in FIG. 7, and second head 200 illustrated in FIG. 11. First head 100 helps to remove impurities from a target site, which is a site to be cleaned, by supplying bubbles to the target site, and stirring the bubbles. Second head 200 helps to remove impurities from the target site by scrubbing the target site with a brush, with the bubbles being supplied to the target site.

A plurality of exemplary embodiments of beauty device 1 can be acquired according to the type of a head mounted to body 10. Beauty device 1 illustrated in FIG. 1, in which first head 100 is mounted to body 10, is a first exemplary embodiment. The accompanying drawings do not illustrate a second exemplary embodiment in which second head 200 is mounted to body 10.

Body 10 includes housing 11 accommodating various elements (drive source 14 (refer to FIG. 3) and the like) therein; cap 12 fitted to an apex portion of housing 11; operator 20 operated to drive beauty device 1; and warming mechanism 30. Warming mechanism 30 is disposed in a bottom portion of housing 11.

Figure 2:
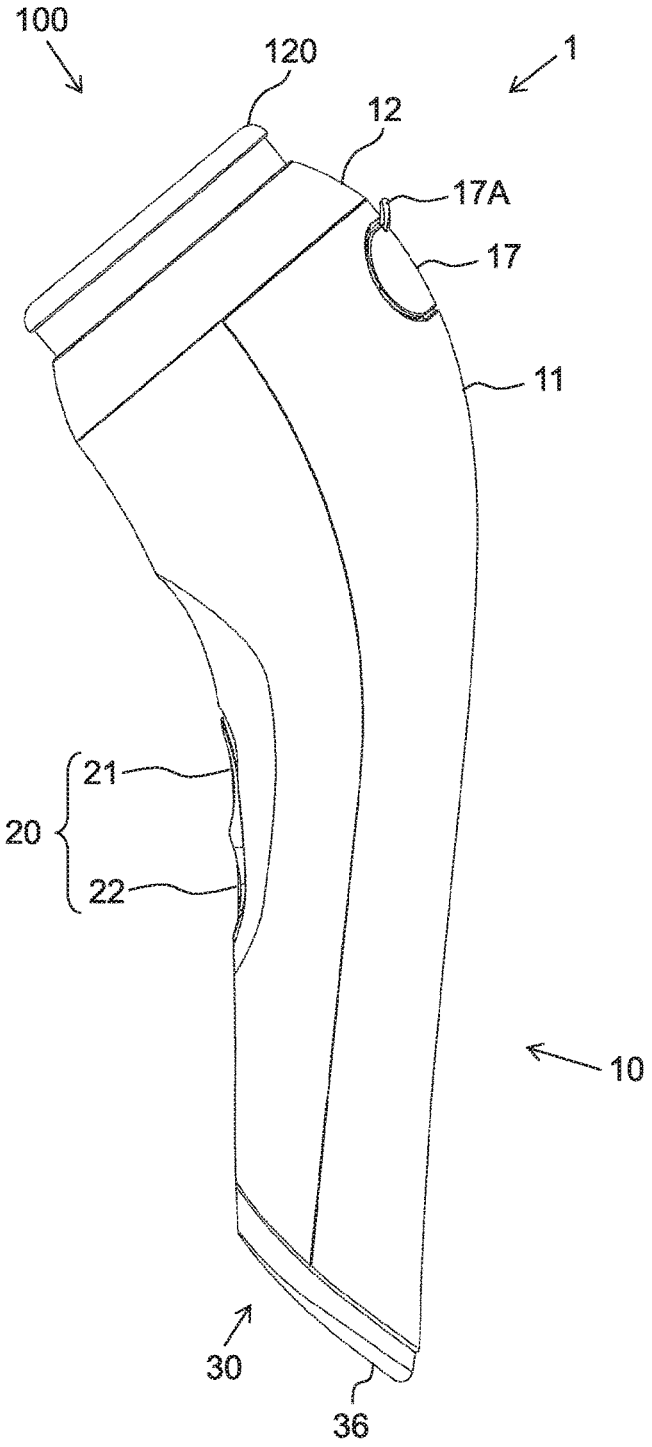
FIG. 2 is a side view of the beauty device in FIG. 1.

Housing 11 has a waterproof mechanism, and is used as a grip. As illustrated in FIG. 2, the apex portion of housing 11 is bent relative to a grip portion of housing 11. Therefore, when a user grips the grip portion of housing 11, the user easily brings first head 100 or second head 200 (refer to FIG. 11) into contact with the skin of the user.

Filler port 18 (refer to FIG. 5) for filling a foaming agent into housing 11 is formed in a rear surface of housing 11. The foaming agent used in beauty device 1 is a liquid, gel-like, tube-shaped, or solid material, or the like. A tube-shaped facial cleanser on the market is an example of the foaming agent. Body 10 further includes lid 17 for closing filler port 18. Lid 17 includes knob 17A. When knob 17A is pulled, lid 17 is separated from housing 11, and filler port 18 is opened.

An example of an exemplary embodiment of operator 20 is a button. Operator 20 includes first operator 21 for switching drive source 14 (refer to FIG. 3) between a turn-on state and a turn-off state, and second operator 22 for switching warming mechanism 30 between a turn-on state and a turn-off state. As an example, first operator 21 is provided on the cap 12 side of housing 11, and second operator 22 is provided on the warming mechanism 30 side of housing 11.

When first operator 21 is operated, first operator 21 outputs an ON signal which is an operation signal for switching drive source 14 from a turn-off state to a turn-on state, or an OFF signal which is an operation signal for switching drive source 14 from a turn-on state to a turn-off state. When second operator 22 is operated, second operator 22 outputs an ON signal which is an operation signal for switching warming mechanism 30 from a turn-off state to a turn-on state, or an OFF signal which is an operation signal for switching warming mechanism 30 from a turn-on state to a turn-off state.

Figure 3:
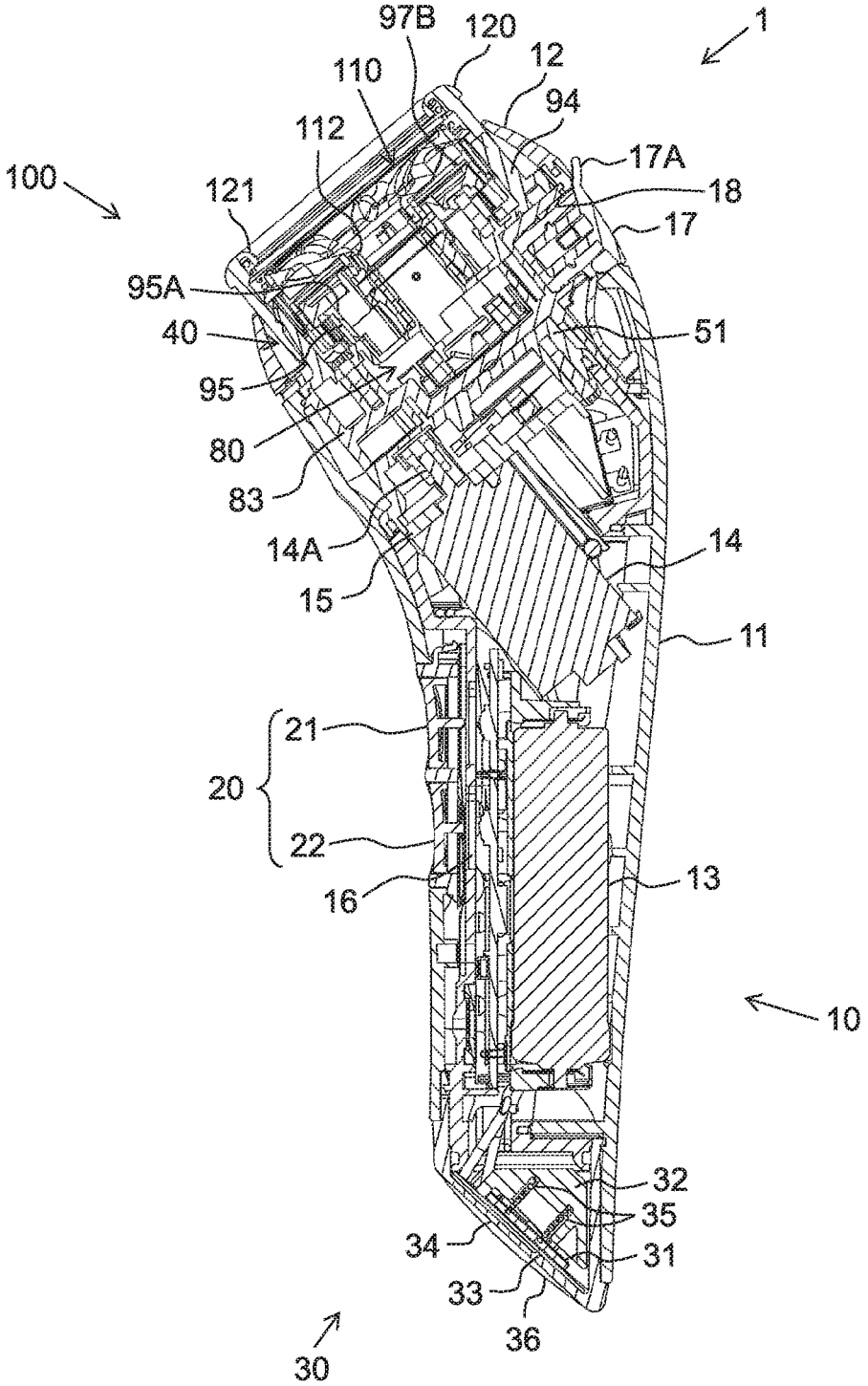
FIG. 3 is a sectional view taken along line III-III in FIG. 1.

FIG. 3 illustrates an internal structure of beauty device 1. Body 10 further includes power supply unit 13 supplying electrical power of a primary battery or a rechargeable battery to each electric block; drive source 14 driven by electrical power supplied from power supply unit 13; base 15 holding drive source 14; and drive mechanism 40 made up of a plurality of mechanical elements. A motor is an example of drive source 14, and output shaft 14A of drive source 14 is connected to a portion of drive mechanism 40.

Body 10 further includes controller 16 controlling drive source 14 and warming mechanism 30. Controller 16 controls drive source 14 and warming mechanism 30 according to an operation signal output from first operator 21 and second operator 22. Controller 16 executes inhibition control such that one of drive source 14 and warming mechanism 30 is not driven when the other of drive source 14 and warming mechanism 30 is driven.

Controller 16 stores a flag for inhibiting the driving of warming mechanism 30 when drive source 14 is driven, or a flag for inhibiting the driving of drive source 14 when warming mechanism 30 is driven in a storage element (not illustrated) such as a flash memory. Controller 16 executes inhibition control according to this flag.

Warming mechanism 30 includes warming surface 36 provided in a bottom portion of housing 11; heater 31 driven by electrical power supplied from power supply unit 13; base 32 holding heater 31; and heat transfer plate 33 transferring heat of heater 31 to warming surface 36. Warming mechanism 30 further includes thermistor 34 controlling the temperature of heater 31, and spring 35 pressing heater 31 against heat transfer plate 33 by applying force to heater 31.

Figure 4:
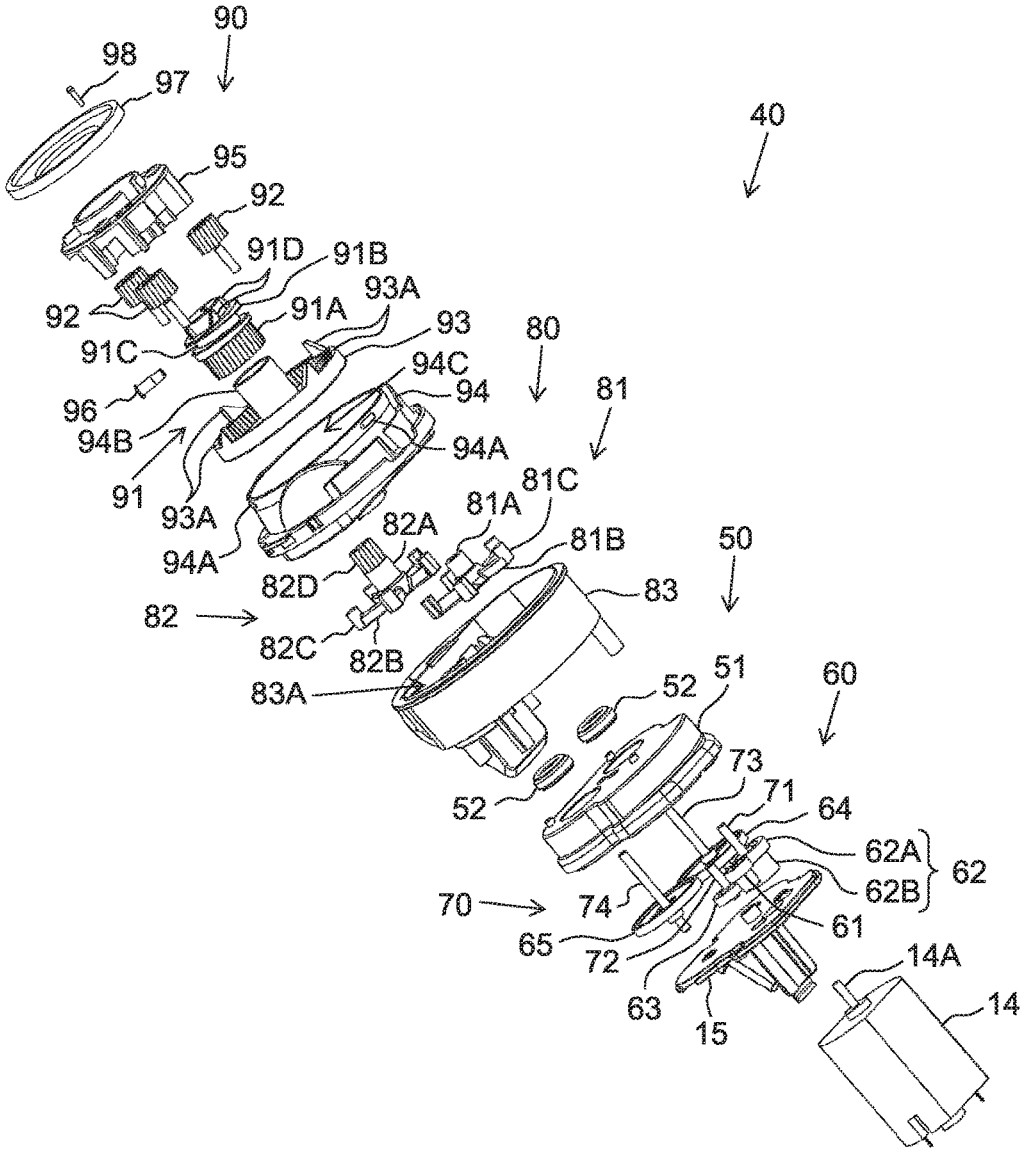
FIG. 4 is an exploded perspective view of a drive mechanism in FIG. 3.

FIG. 4 is an exploded perspective view of drive mechanism 40. Drive mechanism 40 includes bubble generation mechanism 80 for generating and supplying bubbles to first head 100 (refer to FIG. 1); first transmission block 50 transmitting the drive force of drive source 14 to bubble generation mechanism 80; and second transmission block 90 transmitting the drive force of drive source 14 to first head 100.

Figure 5:
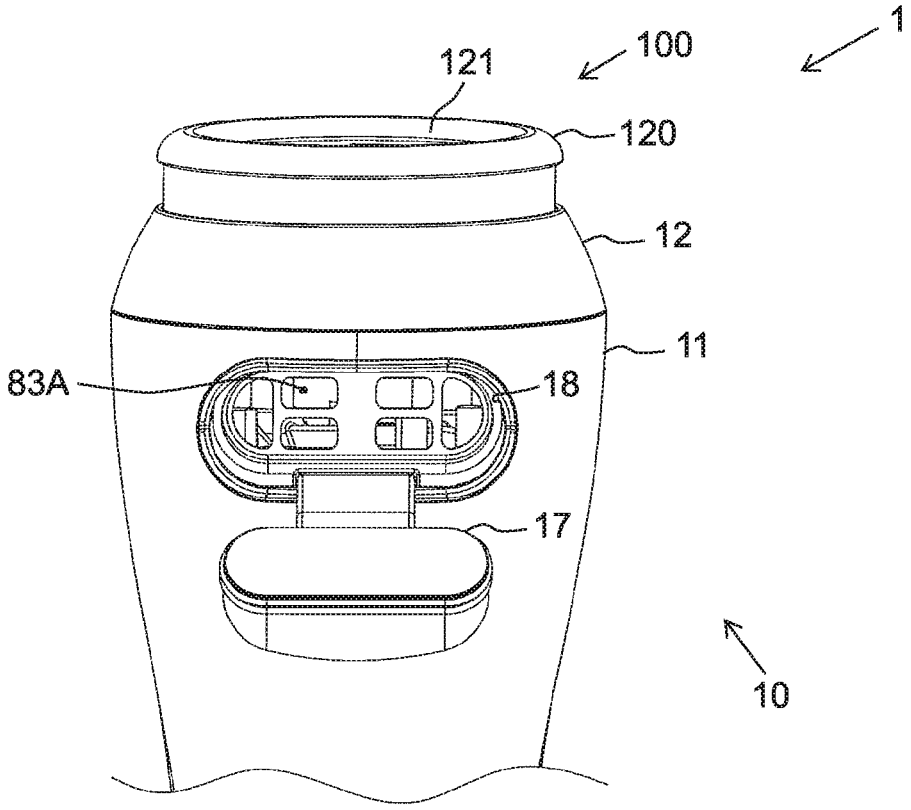
FIG. 5 is a rear view of the beauty device in which a lid in FIG. 2 is open.

Bubble generation mechanism 80 includes first rotor 81 and second rotor 82 which generate bubbles by stirring a foaming agent with water, and container 83 having space 83A in which the foaming agent and water can be stored. First rotor 81 and second rotor 82 are disposed in space 83A of container 83, and rotate opposite to each other. As illustrated in FIG. 5, space 83A communicates with filler port 18 of body 10.

As illustrated in FIG. 4, first transmission block 50 includes gear group 60 which is an aggregate of a plurality of gears; support shaft group 70 which is an aggregate of shafts supporting gear group 60; gear case 51 accommodating gear group 60; and two packings 52 preventing liquid or the like from flowing into gear case 51. Gear case 51 is joined to base 15.

Gear group 60 includes rotation drive gear 61; composite gear 62; rotation change gear 63; first rotation transmission gear 64; and second rotation transmission gear 65. Composite gear 62 includes two gears having different diameters, that is, first composite gear 62A and second composite gear 62B.

Support shaft group 70 includes first support shaft 71 joined to composite gear 62; second support shaft 72 joined to rotation change gear 63; third support shaft 73 joined to first rotation transmission gear 64; and fourth support shaft 74 joined to second rotation transmission gear 65.

One of packings 52 is attached to a hole of gear case 51, through which third support shaft 73 passes. The other of packings 52 is attached to a hole of gear case 51, through which fourth support shaft 74 passes. Therefore, liquid or the like is prevented from flowing into gear case 51 from container 83.

Gear group 60 forms two power transmission paths as described below.

A first power transmission path is formed as described below. Output shaft 14A of drive source 14 supports rotation drive gear 61. Output shaft 14A and rotation drive gear 61 rotate integrally. Rotation drive gear 61 meshes with first composite gear 62A. First composite gear 62A meshes with first rotation transmission gear 64. First rotation transmission gear 64 and third support shaft 73 rotate integrally. Third support shaft 73 supports first rotor 81. Third support shaft 73 and first rotor 81 rotate integrally.

When output shaft 14A and rotation drive gear 61 rotate, the rotation is transmitted sequentially from rotation drive gear 61, to first composite gear 62A, to first rotation transmission gear 64, and to first rotor 81. As an example, gears 61, 62A, and 64 reduce the rotation of output shaft 14A, and transmit a reduced rotation output to first rotor 81.

A second power transmission path is formed as described below. First composite gear 62A meshing with rotation drive gear 61, and second composite gear 62B rotate integrally. Second composite gear 62B meshes with rotation change gear 63. Rotation change gear 63 meshes with second rotation transmission gear 65. Second rotation transmission gear 65 and fourth support shaft 74 rotate integrally. Fourth support shaft 74 supports second rotor 82. Fourth support shaft 74 and second rotor 82 rotate integrally.

When output shaft 14A and rotation drive gear 61 rotate, the rotation is transmitted sequentially from rotation drive gear 61, to first composite gear 62A, to second composite gear 62B, to rotation change gear 63, to second rotation transmission gear 65, and to second rotor 82. As an example, gears 61, 62A, 62B, 63, and 65 reduce the rotation of output shaft 14A, and transmit a reduced rotation output to second rotor 82.

First rotor 81 includes base portion 81A joined to third support shaft 73; a plurality of arms 81B extending from base portion 81A in an approximately radial pattern; and column 81C protruding upwards from a tip portion of each of arms 81B. Roots of the plurality of arms 81B are provided equally spaced in a circumferential direction of base portion 81A. Arms 81B and columns 81C help to stir the foaming agent and the like.

Second rotor 82 includes base portion 82A joined to fourth support shaft 74; a plurality of arms 82B extending from base portion 82A in an approximately radial pattern; column 82C protruding upwards from a tip portion of each of arms 82B; and rotation transmission gear 82D jointed to base portion 82A. Roots of the plurality of arms 82B are provided equally spaced in a circumferential direction of base portion 82A. Arms 82B and columns 82C help to stir the foaming agent and the like. Rotation transmission gear 82D meshes with a portion of second transmission block 90.

Figure 11:
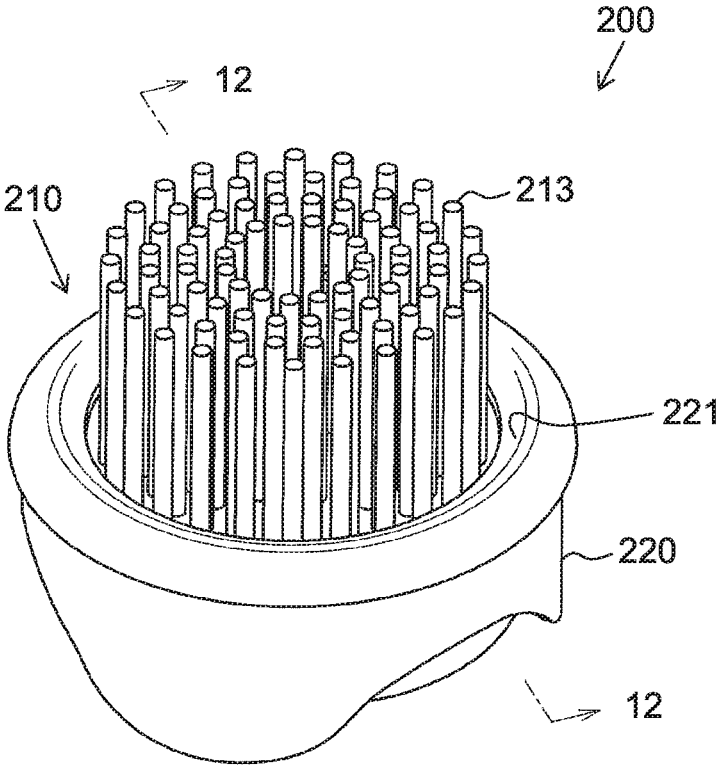
FIG. 11 is a perspective view of a second head in the exemplary embodiment.

Second transmission block 90 includes cam gear 91 which is a first transmission mechanism for transmitting torque to first head 100 (refer to FIG. 1), and ring gear 93 which is a second transmission mechanism for transmitting torque to second head 200 (refer to FIG. 11). Second transmission block 90 further includes a plurality of planetary gears 92 meshing with ring gear 93; head mount unit 94 from which first head 100 and second head 200 can be attached to and detached; and bearing 94B supporting cam gear 91.

Head mount unit 94 includes a plurality of convex portions 94A fitted to concave portions 123 (refer to FIG. 8) formed in first head 100, and accommodation space 94C which is a space for accommodating gears 91, 92, and 93, and the like. Bearing 94B is disposed in accommodation space 94C, and is fixed to head mount unit 94. Cam gear 91 is supported by bearing 94B in such a way as to be capable of rotating relative to bearing 94B. Cam gear 91 and bearing 94B are hollow elements. A space formed inside each of these elements communicates with space 83A of container 83.

Second transmission block 90 further includes gear cover 95 covering the gears; pin 96 inserted into a hole (not illustrated) of gear cover 95; and ring 97 disposed on an upper surface of gear cover 95. Gear cover 95 and ring 97 are fixed to head mount unit 94 using screw 98. Ring 97 serves to prevent liquid or the like from flowing into gear cover 95, and to prevent pin 96 from coming out in a radial direction of cam gear 91.

Cam gear 91 includes geared portion 91A meshing with rotation transmission gear 82D; cam portion 91B transforming the rotation of geared portion 91A into a vertical motion relative to head mount unit 94; and a plurality of hooks 91D transmitting the rotation of geared portion 91A to first head 100. Helical groove 91C is formed in an outer circumference of cam portion 91B.

Figure 6:
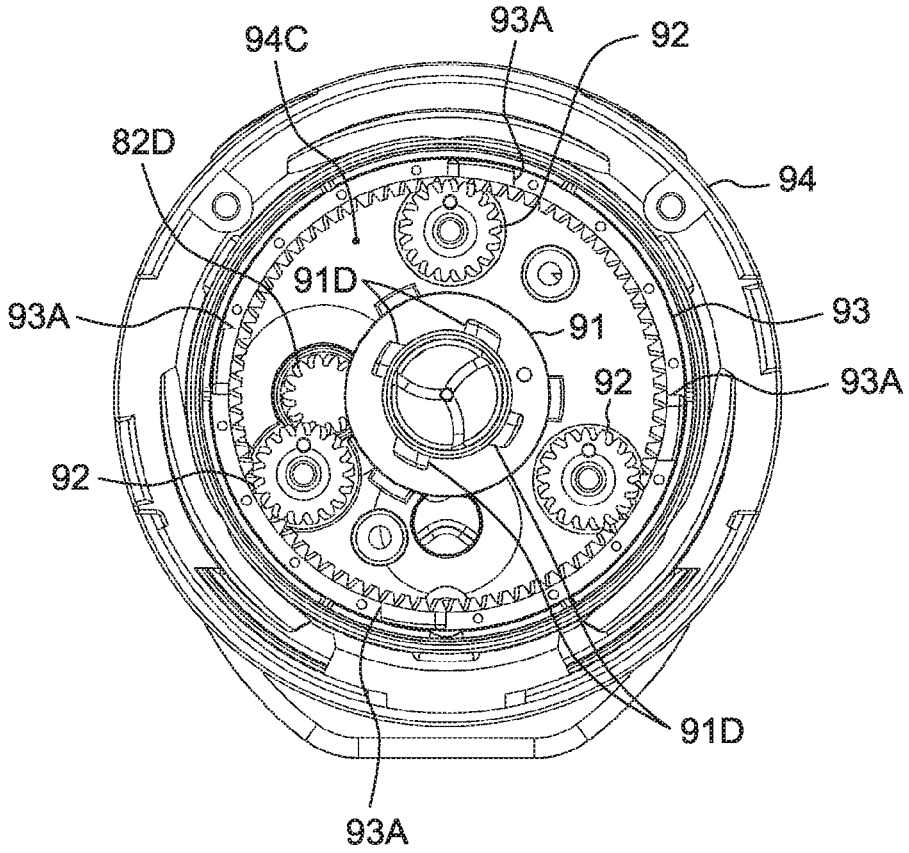
FIG. 6 is a top view of the drive mechanism in FIG. 4 in a state where the illustration of a portion of the drive mechanism is omitted.

FIG. 6 is a top view illustrating the gears of second transmission block 90. Rotation transmission gear 82D meshes with geared portion 91A (refer to FIG. 4) of cam gear 91, and one of planetary gears 92. Planetary gears 92 are disposed equally spaced around the circumference of cam gear 91, and mesh with ring gear 93.

Ring gear 93 is disposed in accommodation space 94C of head mount unit 94, and is supported by head mount unit 94 in such a way as to be capable of rotating relative to head mount unit 94. As illustrated in FIG. 4, a plurality of hooks 93A are provided in ring gear 93, and transmit the rotation of ring gear 93 to second head 200 (refer to FIG. 11). The rotational speed of ring gear 93 is lower than that of cam gear 91. Therefore, the movement speed of second head 200 is lower than the movement speed of first head 100.

Gear cover 95 is attached to head mount unit 94 such that an opening of head mount unit 94 is closed. Therefore, cam gear 91, planetary gears 92, and ring gear 93 are covered with gear cover 95. Pin 96 is inserted into the hole of gear cover 95 from an outer circumferential side of gear cover 95. A tip portion of pin 96 is inserted into groove 91C of cam gear 91. Due to a relationship between groove 91C and pin 96, when cam gear 91 rotates, force is applied to cam gear 91 in an axial direction of cam gear 91, and cam gear 91 moves relative to head mount unit 94 in the axial direction.

Cam gear 91 moves in a first axial direction toward first head 100 or second head 200, or in a second axial direction which is a direction opposite to the first axial direction and toward the inside of body 10. The axial position of cam gear 91 relative to head mount unit 94 is changed in a range between a first position, which is a limit position in the first axial direction, and a second position which is a limit position in the second axial direction.

When first head 100 is mounted to body 10 (refer to FIG. 1), hooks 91D come into contact with side surfaces of hooks 115 (refer to FIG. 8) of stirring mechanism 110 in a circumferential direction of cam gear 91, and an apex portion of cam gear 91 comes into contact with bottom surfaces of hooks 115 of stirring mechanism 110 in the axial direction of cam gear 91.

Therefore, stirring mechanism 110 rotates along with the rotation of cam gear 91 due to a relationship between hooks 91D and the side surfaces of hooks 115 of stirring mechanism 110. When cam gear 91 moves in the first axial direction, due to a relationship between the apex portion of cam gear 91 and the bottom surfaces of hooks 115 of stirring mechanism 110, stirring mechanism 110 is pressed in the first axial direction in which stirring mechanism 110 moves away from body 10.

In contrast, when cam gear 91 moves in the second axial direction, due to the action of at least one of gravity applied to stirring mechanism 110 and a reaction force of elastic member 130 (refer to FIG. 8) disposed in first head 100, stirring mechanism 110 moves in the second axial direction in which stirring mechanism 110 approaches body 10. That is, when cam gear 91 rotates, stirring mechanism 110 rotates relative to head case 120, and moves relative to head case 120 in the axial direction.

In this manner, a drive force of drive source 14 is transmitted to bubble generation mechanism 80 via first transmission block 50, and then is transmitted to second transmission block 90. Therefore, when first head 100 is mounted to body 10 (refer to FIG. 1), both bubble generation mechanism 80 and first head 100 are driven by the drive force of drive source 14.

Figure 7:
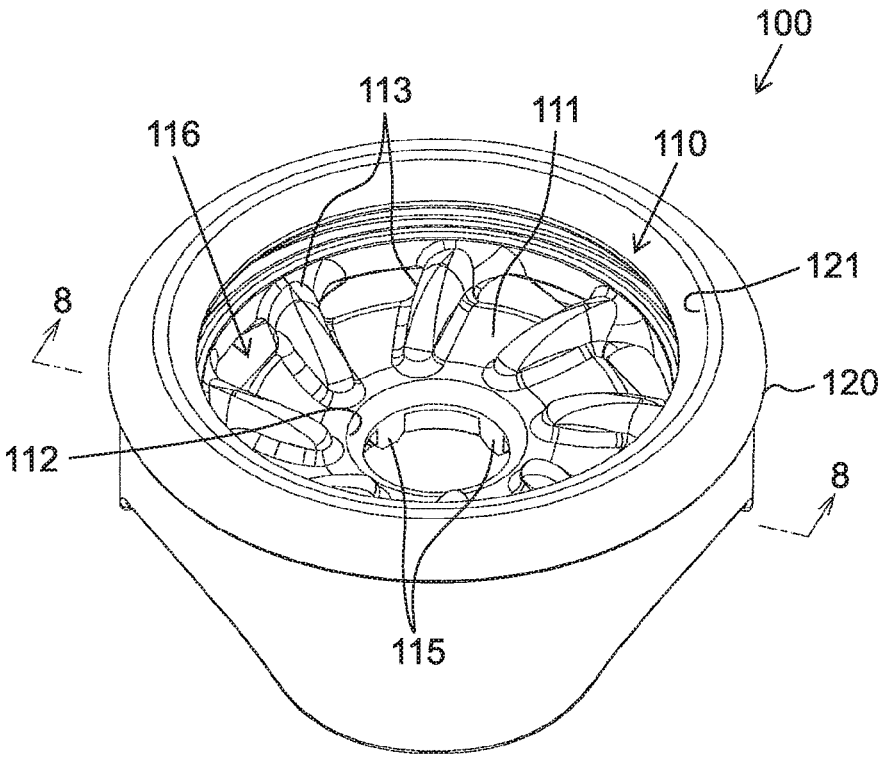
FIG. 7 is a perspective view of a first head in FIG. 1.

FIG. 7 is a perspective view of first head 100. First head 100 includes stirring mechanism 110 for stirring bubbles, and head case 120 forming opening 121 through which bubbles pass. Head case 120 is formed to cover the circumference of stirring mechanism 110.

Stirring mechanism 110 is driven by a drive force of drive source 14 (refer to FIG. 4). Stirring mechanism 110 includes base 111 provided with discharge port 112 through which a mixture of the foaming agent and water passes, and a plurality of blades 113 formed on an opening 121-side surface of base 111. Discharge port 112 is formed in a center portion of base 111. The plurality of blades 113 are formed in a radial pattern around discharge port 112, and for example, the number of blades 113 is eight. An example of a mixture of the foaming agent and water is liquid or bubbles. When the foaming agent is not sufficiently mixed with water, liquid and heavy bubbles are generated as a mixture. When the foaming agent is sufficiently mixed with water, bubbles are generated as a mixture. For example, the heavy bubbles are bubbles contain a large amount of liquid.

Figure 8:
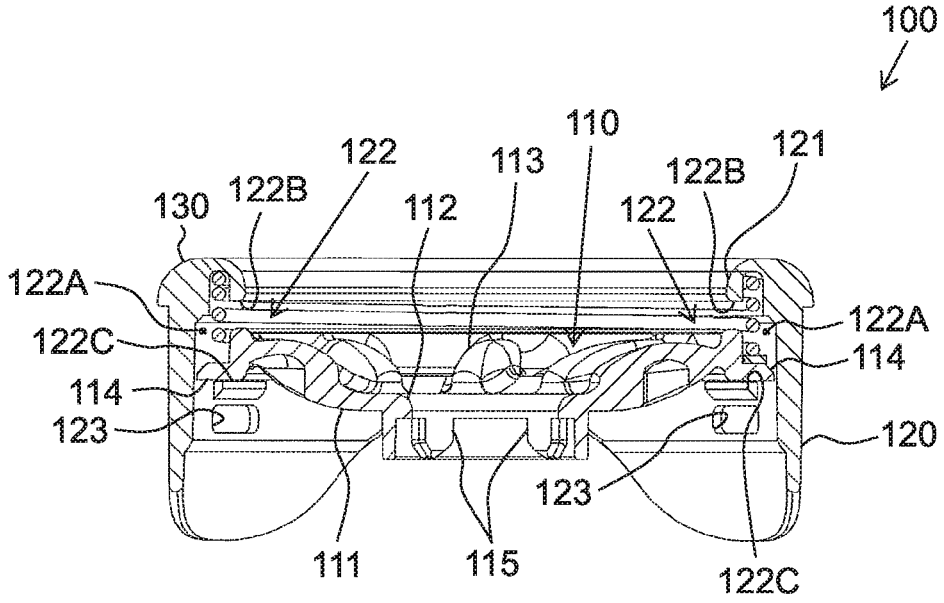
FIG. 8 is a sectional view taken along line VIII-VIII in FIG. 7.

FIG. 8 illustrates an internal structure of first head 100.

Base 111 further includes fitting portion 114 protruding outwards from an outer circumferential portion of base 111 in the radial direction, and a plurality of hooks 115 coming in contact with the plurality of hooks 91D (refer to FIG. 4) of cam gear 91.

Head case 120 includes support portion 122 by which stirring mechanism 110 is supported in such a way as to be capable of rotating and moving relative to head case 120, and a plurality of concave portions 123 respectively fitted to the plurality of convex portions 94A (refer to FIG. 4) of head mount unit 94. The plurality of concave portions 123 are formed in an inner circumferential surface of head case 120. The plurality of concave portions 123 are fitted to the plurality of convex portions 94A such that first head 100 is mounted to body 10 (refer to FIG. 1).

Support portion 122 includes groove 122A formed along an inner circumference of head case 120; first limiting portion 122B regulating one end portion of groove 122A; and second limiting portion 122C regulating the other end portion of groove 122A.

Fitting portion 114 of stirring mechanism 110 is fitted into groove 122A. The groove width of groove 122A, which is a dimension of groove 122A in an axial direction of stirring mechanism 110, is greater than the thickness of fitting portion 114. Therefore, fitting portion 114 is capable of axially moving inside groove 122A relative to head case 120. That is, stirring mechanism 110 is capable of moving relative to head case 120 in a direction in which stirring mechanism 110 approaches opening 121, and in a direction in which stirring mechanism 110 moves away from opening 121.

Fitting portion 114 comes into contact with first limiting portion 122B or second limiting portion 122C such that the position of stirring mechanism 110 relative to head case 120 is limited. First limiting portion 122B limits the position of stirring mechanism 110 such that stirring mechanism 110 is not allowed to protrude out of opening 121. Second limiting portion 122C limits the position of stirring mechanism 110 such that stirring mechanism 110 is not allowed to fall out of head case 120. As an example, second limiting portion 122C is formed of a plurality of protrusions that are provided equally spaced on the inner circumferential surface of head case 120. First limiting portion 122B is an example of a limiting portion.

When first head 100 is mounted to body 10, the side surfaces of hooks 115 and the side surfaces of corresponding hooks 91D come into contact with each other in a circumferential direction of stirring mechanism 110, and the bottom surfaces of hooks 115 and the apex portion of cam gear 91 come into contact with each other in the axial direction of cam gear 91. Therefore, the rotation and the axial movement of cam gear 91 are transmitted to stirring mechanism 110. In addition, stirring mechanism 110 moves in the axial direction while rotating relative to head case 120.

First head 100 further includes elastic member 130 which is disposed between fitting portion 114 and first limiting portion 122B, and presses stirring mechanism 110 in a direction in which stirring mechanism 110 moves away from opening 121. An example of elastic member 130 is a spring.

When cam gear 91 is present at the second position in which cam gear 91 is farthest separated from opening 121, stirring mechanism 110 is pressed against second limiting portion 122C due to a reaction force of elastic member 130. When cam gear 91 is present at the first position in which cam gear 91 most closely approaches opening 121, stirring mechanism 110 is pressed against first limiting portion 122B due to force from cam gear 91. When cam gear 91 approaches the first position from the second position, stirring mechanism 110 approaches first limiting portion 122B against a reaction force of elastic member 130.

Figure 9:
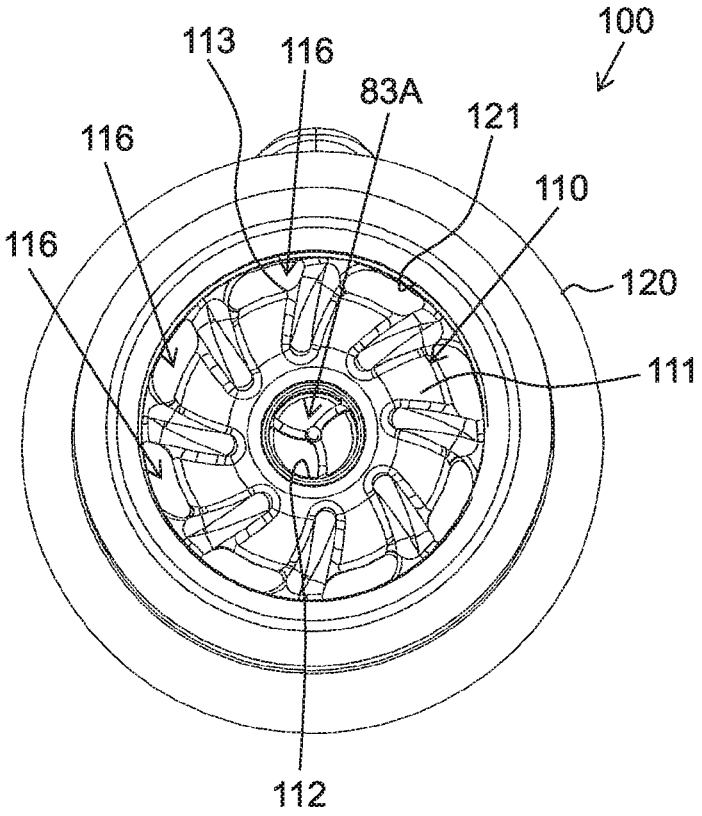
FIG. 9 is a top view of the first head in FIG. 1 which is mounted to a body.

FIG. 9 is a top view of first head 100 mounted to body 10. Stirring mechanism 110 further includes a plurality of return ports 116 through which liquid or bubbles discharged from discharge port 112 return to container 83. Each of return ports 116 passes through stirring mechanism 110. As an example, each of return ports 116 is formed in an outer circumferential portion of base 111, and between adjacent blades 113.

Figure 10:
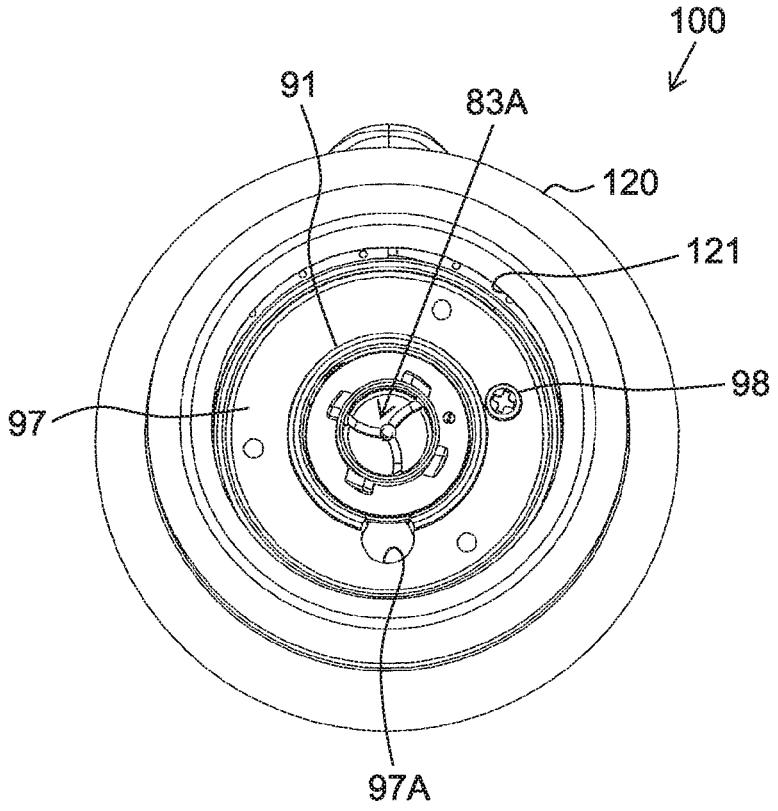
FIG. 10 is a top view of the first head when a stirring mechanism is omitted from FIG. 9.

FIG. 10 is a top view of first head 100 from which stirring mechanism 110 is omitted. Ring 97 includes hole 97A through which liquid or bubbles, which have passed through return ports 116 (refer to FIG. 9) and moved onto ring 97, return to container 83 (refer to FIG. 4). Hole 97A communicates with return passage 95A (refer to FIG. 3) formed in gear cover 95 (refer to FIG. 3). Return passage 95A passes through gear cover 95 in the axial direction.

Space 97B (refer to FIG. 3) is formed between stirring mechanism 110 illustrated in FIG. 9 and ring 97 illustrated in FIG. 10. A surface-side space of base 111 communicates with space 97B via return ports 116 in FIG. 9. Space 97B communicates with return passage 95A of gear cover 95 via hole 97A illustrated in FIG. 10. Hole 97A communicates with space 83A of container 83 via return passage 95A. In this manner, return ports 116 communicate with space 83A of container 83.

Bubbles or liquid, that is, a mixture generated by bubble generation mechanism 80 (refer to FIG. 4) are discharged to a surface side of stirring mechanism 110 from discharge port 112 of stirring mechanism 110. When a mixture of liquid and heavy bubbles is discharged from discharge port 112, the liquid and bubbles are likely to be accumulated on the surface of base 111. Due to centrifugal force induced by the rotation of stirring mechanism 110, the liquid and heavy bubbles staying on the surface of base 111 move to the outer circumferential portion of stirring mechanism 110, and flow through one return port 116 or a plurality of return ports 116. The liquid and heavy bubbles passing through return ports 116 flow sequentially through space 97B, hole 97A, and return passage 95A, and return into space 83A of container 83. The liquid and heavy bubbles, which have returned into space 83A, are stirred by bubble generation mechanism 80 (refer to FIG. 4) again.

FIG. 11 is a perspective view of second head 200. In a description of second head 200, the same reference signs are assigned to configuration elements common to first head 100, and a portion of the entirety of a description of each of the configuration elements will be omitted. Second head 200 includes brush mechanism 210 used to clean a target site, and head case 220 forming opening 221 through which bubbles pass. Head case 220 is formed to cover the circumference of brush mechanism 210.

Figure 12:
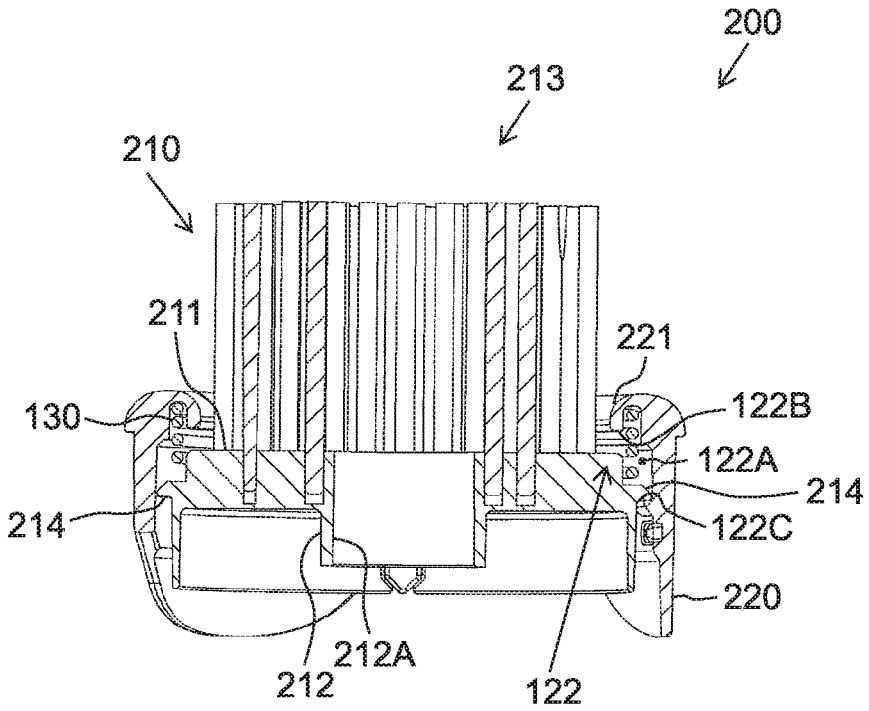
FIG. 12 is a sectional view taken along line XII-XII in FIG. 11.

FIG. 12 illustrates an internal structure of second head 200. Brush mechanism 210 includes base 211 provided with discharge port 212A through which bubbles pass; cylinder 212 formed at the center of base 211; and brushes 213 planted into an opening 221-side surface of base 211. An opening 221 (of head case 220)-side space of base 211 communicates with a body 10-side space of base 211 via discharge port 212A that is a space inside cylinder 212. The material of brushes 213 is preferably flexible.

Base 211 further includes fitting portion 214 formed in an outer circumferential portion of base 211, and a plurality of hooks (not illustrated) coming into contact with the plurality of hooks 93A (refer to FIG. 4) of ring gear 93. Fitting portion 214 is fitted into groove 122A formed in head case 220.

The groove width of groove 122A, which is a dimension of groove 122A in an axial direction of brush mechanism 210, is greater than the thickness of fitting portion 214. Therefore, fitting portion 214 is capable of axially moving inside groove 122A relative to head case 220. That is, brush mechanism 210 is capable of moving relative to head case 220 in a direction in which brush mechanism 210 approaches opening 221, and in a direction in which brush mechanism 210 moves away from opening 221.

Fitting portion 214 comes into contact with first limiting portion 122B or second limiting portion 122C such that the position of brush mechanism 210 relative to head case 220 is limited. First limiting portion 122B limits the position of brush mechanism 210 such that brush mechanism 210 is not allowed to protrude out of opening 221. Second limiting portion 122C limits the position of brush mechanism 210 such that brush mechanism 210 is not allowed to fall out of head case 220.

Second head 200 operates as described below.

When second head 200 is mounted to body 10 (refer to FIG. 1), and is driven by drive source 14 (refer to FIG. 4), a drive force of drive source 14 is transmitted to bubble generation mechanism 80 (refer to FIG. 4) via first transmission block 50 (refer to FIG. 4). The drive force is then transmitted second transmission block 90 (refer to FIG. 4). Therefore, both bubble generation mechanism 80 and second transmission block 200 are driven by the drive force of drive source 14.

When second head 200 is mounted to body 10, a bottom surface of cylinder 212 comes into contact with the apex portion of cam gear 91 (refer to FIG. 4) in the axial direction of cam gear 91. Unlike the case in which first head 100 is mounted to body 10, the side surfaces of hooks 91D (refer to FIG. 4) of cam gear 91 do not come into contact with brush mechanism 210 in the circumferential direction of cam gear 91. Therefore, only the axial movement of cam gear 91 is transmitted to brush mechanism 210, and the rotation of cam gear 91 is not transmitted.

When second head 200 is mounted to body 10, side surfaces of the hooks of base 211 come into contact with the side surfaces of hooks 93A of ring gear 93 in the circumferential direction of cam gear 91. Therefore, the rotation of ring gear 93 is transmitted to brush mechanism 210. Since the rotational speed of ring gear 93 is lower than that of cam gear 91, when cam gear 91 rotates at the same rotational speed as ring gear 93, brush mechanism 210 rotates at a rotational speed lower than that of stirring mechanism 110.

Figure 13:
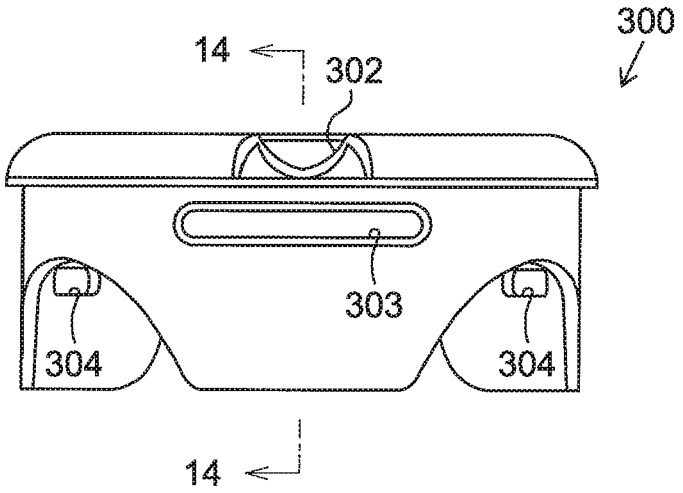
FIG. 13 is a front view of a head cap in the exemplary embodiment.
Figure 14:
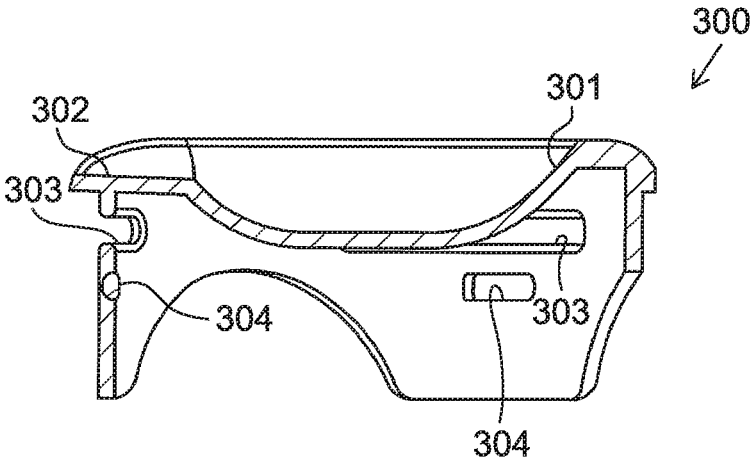
FIG. 14 is a sectional view taken along line XIV-XIV in FIG. 13.

FIGS. 13 and 14 illustrate head cap 300 to be mounted to body 10. Head cap 300 is mounted to body 10 (refer to FIG. 1) to which first head 100 (refer to FIG. 1) and second head 200 (refer to FIG. 11) have not been mounted.

Head cap 300 includes meter 301 for metering water; pouring port 302 for pouring out water stored in meter 301; air ventilation hole 303 for allowing the ventilation of air between the inside and outside of body 10; and a plurality of concave portions 304 fitted to the plurality of convex portions 94A (refer to FIG. 4) of head mount unit 94. When the plurality of convex portions 94A are fitted to the plurality of concave portions 304, head cap 300 is mounted to body 10, and it is unlikely that liquid or the like leaks to the outside from the inside of body 10.

The operation of beauty device 1 will be described with reference to FIGS. 1 and 4.

According to the first exemplary embodiment of beauty device 1, a user uses beauty device 1 as described below. In a first step, first head 100 is mounted to body 10. In a second step, lid 17 (refer to FIG. 5) is opened. In a third step, space 83A is filled with a predetermined amount of a foaming agent via filler port 18 (refer to FIG. 5). In a fourth step, space 83A is filled with a predetermined amount of water via one of filler port 18 and discharge port 112. In a fifth step, head case 120 is brought into contact with the skin while opening 121 faces the skin. In a sixth step, first operator 21 is operated to switch drive source 14 from a turn-off state to a turn-on state.

When drive source 14 is driven, a drive force of drive source 14 is transmitted to bubble generation mechanism 80 and stirring mechanism 110. Bubble generation mechanism 80 is driven to generate bubbles, and to supply the bubbles to the surface side of base 111 through discharge port 112. Therefore, bubbles are present between stirring mechanism 110 and the skin. Stirring mechanism 110 moves in the vertical direction while rotating relative to head case 120. In a state where bubbles are present between stirring mechanism 110 and the skin, the bubbles are stirred and moved between stirring mechanism 110 and the skin by blades 113, and thus impurities of the skin are removed by the bubbles.

In beauty device 1, the movement of bubbles formed by stirring mechanism 110 considerably contributes to the removal of impurities from the skin. Therefore, even if beauty device 1 does not include another means for removing impurities from the skin, it is easy to sufficiently remove impurities from the skin. As another example, a beauty device includes brushes which are means for removing impurities from the skin. In this beauty device, the brushes are strongly pressed against the skin, and thus strong irritation may be applied to the skin, which is a problem. In contrast, beauty device 1 according to this disclosure does not include brushes which may apply strong irritation to the skin, and thus it is unlikely that strong irritation is applied to the skin compared to the aforementioned beauty device.

The first exemplary embodiment of beauty device 1 is capable of further providing a user with the following usage pattern. When a desire of a user is to completely remove cosmetics with which the skin is coated, the following additional steps are added between the first step and the second step. In a first additional step, second operator 22 is operated to switch warming mechanism 30 from a turn-off state to a turn-on state. In a second additional step which is subsequent to the first additional step, warming surface 36 warmed up by heater 31 (refer to FIG. 3) is brought into contact with the skin. Therefore, the skin is warmed up, and cosmetics are easily removed. After the skin is warmed up for a predetermined amount of time by warming mechanism 30, in a third additional step which is subsequent to the second additional step, second operator 22 is operated to switch warming mechanism 30 from a turn-on state to a turn-off state. Impurities are removed from the skin in the steps subsequent to the second step.

When a desire of a user is to more completely remove impurities from the skin, the user can select the second exemplary embodiment of beauty device 1. According to the second exemplary embodiment of beauty device 1, a user uses beauty device 1 as described below. In a first step, second head 200 (refer to FIG. 11) is mounted to body 10.

The same second to fourth steps as in the first exemplary embodiment are performed. In a fifth step, brushes 213 are brought into contact with the skin. In a sixth step, first operator 21 is operated to switch drive source 14 from a turn-off state to a turn-on state.

When drive source 14 is driven, a drive force of drive source 14 is transmitted to bubble generation mechanism 80 and brush mechanism 210. Bubble generation mechanism 80 is driven to generate bubbles, and to supply the bubbles to the surface side of base 211 through discharge port 212A. Therefore, bubbles are present between brushes 213 and the skin. Brushes 213 rotate relative to head case 220. In a state where bubbles are present between brushes 213 and the skin, brushes 213 scrub the skin, and thus impurities of the skin are removed by brushes 213 and the bubbles.

According to beauty device 1 in the exemplary embodiments, it is possible to obtain the following effects.

(1) In first head 100 of beauty device 1, the circumference of stirring mechanism 110 is covered with head case 120. Therefore, it is unlikely that bubbles supplied to stirring mechanism 110, or bubbles stirred by stirring mechanism 110 splash onto the circumference of stirring mechanism 110. As a result, the ease of use of beauty device 1 is improved.

(2) In first head 100 of beauty device 1, when stirring mechanism 110 rotates relative to head case 120, bubbles are stirred. Therefore, stirring mechanism 110 is likely to homogeneously stir bubbles compared to when bubbles are stirred by the flow of air.

(3) Stirring mechanism 110 is supported by support portion 122 in such a way as to be capable of approaching opening 121 of head case 120, and moving away from opening 121. When stirring mechanism 110 moves relative to head case 120, bubbles supplied to the surface side of stirring mechanism 110 are stirred. Therefore, the bubbles are moved between stirring mechanism 110 and the skin, and thus impurities are removed from the skin.

(4) Support portion 122 includes first limiting portion 122B as a limiting portion which limits the position of stirring mechanism 110 such that stirring mechanism 110 is not allowed to protrude out of opening 121. Therefore, when head case 120 is brought into contact with the skin while opening 121 faces the skin, stirring mechanism 110 is further separated from the skin than a contact surface between head case 120 and the skin. Therefore, stirring mechanism 110 is unlikely to come into contact with the skin. As a result, stirring mechanism 110 is less likely to apply irritation to the skin.

(5) In first head 100 of beauty device 1, bubbles are supplied to the surface side of base 111 from discharge port 112 formed in the center portion of base 111, and thus it is easy to equally supply bubbles to regions on the surface side of base 111. The bubbles supplied to the surface side of base 111 are stirred by the plurality of blades 113 which are formed in a radial pattern. Therefore, the bubbles are more homogeneously likely to be stirred.

(6) Bubbles may be generated in a state where the foaming agent is not sufficiently mixed with water. The bubbles are heavy compared to bubbles which are generated when the foaming agent is sufficiently mixed with water. In first head 100 of beauty device 1, the plurality of return ports 116 are formed in the outer circumferential portion of base 111. Therefore, when the heavy bubbles are supplied to the surface side of stirring mechanism 110, the bubbles flow to space 83A through return ports 116 due to centrifugal force induced by the rotation of stirring mechanism 110. As a result, it is unlikely that heavy bubbles are accumulated on the surface of stirring mechanism 110. Even if liquid is generated due to insufficient mixing of the foaming agent with water, and the liquid is supplied to the surface side of stirring mechanism 110, it is possible to obtain the same effects.

The liquid and heavy bubbles, which have returned into space 83A through return ports 116, are stirred by bubble generation mechanism 80 again. Therefore, it is easy to generate bubbles in which the foaming agent is sufficiently mixed with water. Even if excessive bubbles are supplied to the surface side of stirring mechanism 110 from discharge port 112, the bubbles flow to space 83A through return ports 116, and thus bubbles are unlikely to overflow from opening 121.

(7) First head 100 of beauty device 1 includes elastic member 130 which presses stirring mechanism 110 in the direction in which stirring mechanism 110 moves away from opening 121. Therefore, even if a large amount of bubbles stay in space 83A which is present on a back surface side of stirring mechanism 110, it is unlikely that stirring mechanism 110 is prevented from moving relative to head case 120. As a result, a bubble stirring function of stirring mechanism 110 is less likely to deteriorate.

(8) When first head 100 is mounted to body 10 of beauty device 1, torque of drive source 14 is transmitted to first head 100 via cam gear 91 to operate stirring mechanism 110. Instead of first head 100, second head 200 can be mounted to body 10 of beauty device 1. When second head 200 is mounted to body 10, torque of drive source 14 is transmitted to second head 200 via ring gear 93. The functional components of second head 200 rotate at a rotational speed lower than that of stirring mechanism 110. Since stirring mechanism 110 of first head 100 rotates at a speed higher than that of the functional components of second head 200, bubbles supplied to stirring mechanism 110 are more reliably stirred compared to when a relationship in the rotational speed is set differently from the aforementioned relationship.

(9) Drive source 14 drives both bubble generation mechanism 80 and stirring mechanism 110. In this configuration, there is a high possibility that the size of beauty device 1 is reduced, and costs required to manufacture beauty device 1 are reduced compared to when drive sources for driving bubble generation mechanism 80 and stirring mechanism 110 are separately present.

(10) When drive source 14 is driven, controller 16 does not drive warming mechanism 30. In this configuration, when bubble generation mechanism 80 and stirring mechanism 110 are used to clean the skin, and warming mechanism 30 is not used, electrical power is not supplied to warming mechanism 30. Therefore, it is unlikely that electrical power is wasted.

(11) When warming mechanism 30 is driven, controller 16 does not drive source 14. In this configuration, when warming mechanism 30 is used to warm up the skin, and bubble generation mechanism 80 and stirring mechanism 110 are not used, electrical power is not supplied to drive source 14. Therefore, it is unlikely that electrical power is wasted. Bubbles are less likely to be discharged from stirring mechanism 110 which does not face the skin.

(12) Brushes 213 are made of a flexible material. In this configuration, it is unlikely that strong irritation is applied to the skin, compared to when brushes 213 are made of a hard material.

(13) A rotational speed transmitted to brush mechanism 210 by second transmission block 90 is lower than that transmitted to stirring mechanism 110 by first transmission block 50. In this configuration, it is unlikely that strong irritation is applied to the skin, compared to when a relationship in the rotational speed is different from the aforementioned relationship.

(14) First operator 21 is provided on the cap 12 side of housing 11, and second operator 22 is provided on the warming mechanism 30 side of housing 11. In this configuration, the distance between first operator 21 and first head 100 or second head 200, which is driven by the operation of first operator 21, is shorter than the distance between second operator 22 and first head 100 or second head 200. The distance between second operator 22 and warming mechanism 30 driven by second operator 22 is shorter than the distance between first operator 21 and warming mechanism 30. Therefore, it is easy for a user to intuitively recognize a correlation between operator 20 and the mechanism driven by the operation of operator 20, and the user is unlikely to erroneously operate operator 20.

Modification Examples

In the aforementioned description, the obtainable exemplary embodiments of the beauty device, the body of the beauty device, and the head of the beauty device in this disclosure have been exemplified; however, there is no intention of limiting this disclosure to the exemplary embodiments. Other than the exemplary embodiments, the beauty device, the body of the beauty device, and the head of the beauty device in this disclosure are capable of having modification examples of the exemplary embodiments, and a combination of at least two non-conflicting modification examples, which will be described below.

Controller 16 in a modification example executes invalid control so as to avoid driving both drive source 14 and warming mechanism 30. As an example, the invalid control includes first invalid control and second invalid control. According to the first invalid control, when drive source 14 is driven, and an ON signal is input from second operator 22, the ON signal is not accepted. According to the second invalid control, when warming mechanism 30 is driven, and an ON signal is input from first operator 21, the ON signal is not accepted.

In beauty device 1 in a modification example, drive source 14 is mounted to each of heads 100 and 200.

It is possible to arbitrarily select a structure in which bubble generation mechanism 80 and stirring mechanism 110 are driven. As an example, instead of drive source 14, a first drive source for driving bubble generation mechanism 80 and a second drive source for driving stirring mechanism 110 are mounted to body 10. As another example, at least one of the first drive source and the second drive source is mounted to each of heads 100 and 200.

Beauty device 1 including the first drive source and the second drive source in the modification example is capable of further having the following exemplary embodiment. Operator 20 includes a first operator for switching the first drive source between a turn-on state and a turn-off state; a second operator for switching the second drive source between a turn-on state and a turn-off state; and a third operator for switching warming mechanism 30 between a turn-on state and a turn-off state. In this case, controller 16 controls the first drive source, the second drive source, and warming mechanism 30 according to an operation signal output from the first operator, the second operator, and the third operator. As an example, controller 16 further executes at least one of inhibition control equivalent to the inhibition control described in the exemplary embodiments, and invalid control equivalent to the invalid control described in the modification example.

The inhibition control includes at least one of first to fourth inhibition control to be described below. According to the first inhibition control, when the first drive source is driven, the driving of warming mechanism 30 is inhibited. According to the second inhibition control, when the second drive source is driven, the driving of warming mechanism 30 is inhibited. According to the third inhibition control, when warming mechanism 30 is driven, the driving of the first drive source is inhibited. According to the fourth inhibition control, when warming mechanism 30 is driven, the driving of the second drive source is inhibited.

The invalid control includes at least one of first to fourth invalid control to be described below. According to the first invalid control, when the first drive source is driven and an ON signal is output from the third operator, the ON signal is not accepted. According to the second invalid control, when the second drive source is driven and an ON signal is output from the third operator, the ON signal is not accepted. According to the third invalid control, when warming mechanism 30 is driven and an ON signal is output from the first operator, the ON signal is not accepted. According to the fourth invalid control, when warming mechanism 30 is driven and an ON signal is output from the second operator, the ON signal is not accepted.

In beauty device 1 in a modification example, filler port 18 is omitted from body 10. In this case, space 83A is filled with a foaming agent via discharge port 112. In this modification example, beauty device 1 is capable of having a configuration in which lid 17 is omitted.

It is possible to arbitrarily select the types of heads which can be mounted to body 10 of beauty device 1. As an example, a third head is mounted to body 10. Here, the third head has substantially the same configuration as that of first head 100, and when the third head is mounted to head mount unit 94, the third head is connected to the second transmission mechanism. When the third head is used, it is possible to have a stirring operation different from that of first head 100. Therefore, a user can select a usage pattern of beauty device 1 according to a state of the skin or the like. As another example, a fourth head having a function different from those of first head 100 and second head 200 is mounted to body 10. When the fourth head is mounted to head mount unit 94, the fourth head is connected to the first transmission mechanism or the second transmission mechanism.

In beauty device 1 in a modification example, at least one of the first transmission mechanism and the second transmission mechanism is omitted from body 10.

In beauty device 1 in a modification example, body 10 is formed integral with first head 100. Therefore, a user cannot arbitrarily detach first head 100 from head mount unit 94. In this modification example, beauty device 1 is capable of having a configuration in which at least one of the first transmission mechanism and the second transmission mechanism is omitted.

Instead of elastic member 130 or in addition thereto, first head 100 in a modification example includes an elastic member which is disposed between fitting portion 114 and second limiting portion 122C, and pulls stirring mechanism 110 in the direction in which stirring mechanism 110 moves away from opening 121.

In beauty device 1 in a modification example, elastic member 130 is omitted from each of heads 100 and 200.

It is possible to arbitrarily select the positions of formation of return ports 116 in stirring mechanism 110. As an example, return ports 116 are formed around discharge port 112 of base 111.

It is possible to arbitrarily select the number of return ports 116 in stirring mechanism 110. As an example, the number of return ports 116 is one. As another example, return ports 116 are omitted from stirring mechanism 110.

It is possible to arbitrarily select the mode of formation of discharge port 112 in stirring mechanism 110. As an example, in addition to discharge port 112, another discharge port is formed in base 111. As another example, instead of discharge port 112, a discharge port is formed at a location other than the center portion of base 111.

It is possible to arbitrarily select the number of blades 113 formed in stirring mechanism 110. Stirring mechanism 110 in a modification example includes any one of one to seven pieces of blades 113, or any one of nine or more pieces of blades 113.

Head case 120 in a modification example further includes one or a plurality of bars formed in the edge of opening 121. The bars protrude from opening 121 toward a space in which the skin is disposed. In this modification example, the bars come into contact with the skin such that stirring mechanism 110 is more unlikely to come into contact with the skin.

In beauty device 1 in a modification example, head case 120 is omitted from first head 100.

It is possible to arbitrarily select a stirring structure mounted to first head 100. First head 100 in a modification example includes another stirring structure instead of stirring mechanism 110 that stirs bubbles by rotating and moving relative to head case 120. In a first example of the other stirring structure, first head 100 includes a support portion supporting a stirring mechanism that can rotate but cannot move relative to head case 120, and the stirring mechanism supported by the support portion. In a second example of the other stirring structure, first head 100 includes a support portion supporting a stirring mechanism that cannot rotate but can move relative to head case 120, and the stirring mechanism supported by the support portion. In a third example of the other stirring structure, first head 100 includes a stirring mechanism which is a fan supplying air to opening 121.

It is possible to arbitrarily select the position of formation of warming surface 36 in housing 11. As an example, warming surface 36 is formed in a front surface or a back surface of housing 11.

In beauty device 1 in a modification example, warming mechanism 30 is omitted from body 10.

It is possible to arbitrarily select whether or not drive mechanism 40 includes bubble generation mechanism 80. As an example, first transmission block 50 and bubble generation mechanism 80 are omitted from drive mechanism 40. In this case, the rotation of output shaft 14A of drive source 14 is transmitted to cam gear 91 and planetary gears 92 via the plurality of gears. When a user uses beauty device 1 in this modification example, the user supplies bubbles to the skin by themselves or using another means.

It is possible to arbitrarily select the types of foaming agents. As an example, the foaming agent is a liquid agent or a gel-like agent in which an agent having foaming properties is mixed with water. Examples of the agent having foaming properties include a facial cleanser, soap, and a shampoo. When a liquid foaming agent or a gel-like foaming agent is used, it is not necessary to fill space 83 with water, and thus man-hours of a user required to use beauty device 1 are reduced.

(Supplementary Notes Regarding Solutions to Problems)

Supplementary note (1): A beauty device includes a head having a stirring mechanism configured to stir bubbles; and a body having a head mount unit which the head can be attached to and detached from, a drive source configured to output a drive force for driving the head, and a bubble generation mechanism configured to generate and supply bubbles to the head.

Supplementary note (2): In the beauty device described in supplementary note 1, the head further includes a head case provided with an opening through which bubbles pass, and the head case includes a support portion configure to support the stirring mechanism.

Supplementary note (3): In the beauty device described in supplementary note 2, the support portion supports the stirring mechanism in such a way that the stirring mechanism is capable of taking at least one motion of a rotation and a movement relative to the head case.

Supplementary note (4): In the beauty device described in supplementary note 2 or 3, the head case includes a limiting portion configured to limit the position of the stirring mechanism in such a way that the stirring mechanism is not allowed to protrude out of the opening.

Supplementary note (5): In the beauty device described in any one of supplementary notes 1 to 4, the body further includes a filler port which is connected to the bubble generation mechanism, and through which the filling of a foaming agent is performed. The stirring mechanism includes a discharge port which is connected to the bubble generation mechanism, and through which the bubbles, which are generated by the bubble generation mechanism, pass.

Supplementary note (6): In the beauty device described in supplementary note 5, the filler port communicates with the discharge port.

Supplementary note (7): In the beauty device described in any one of supplementary notes 1 to 6, the drive source drives both the stirring mechanism and the bubble generation mechanism.

Supplementary note (8): A beauty device includes a head having a stirring mechanism configured to stir bubbles; a bubble generation mechanism configured to generate and supply bubbles to the head; a drive source configured to drive the stirring mechanism and the bubble generation mechanism; a warming mechanism configured to output heat; and a controller configured to control the drive source and the warming mechanism. When the controller drives one of the drive source and the warming mechanism, the controller is configured not to drive the other of the drive source and the warming mechanism.

Supplementary note (9): A beauty device includes a head having a stirring mechanism configured to stir bubbles; a bubble generation mechanism configured to generate and supply bubbles to the head; a drive source configured to drive the stirring mechanism and the bubble generation mechanism; a warming mechanism configured to output heat; a first operator configured to switch the drive source between a turn-on state and a turn-off state; a second operator configured to switch the warming mechanism between a turn-on state and a turn-off state; and a controller configured to control the drive source and the warming mechanism according to an operation signal output from the first operator and the second operator. When the drive source is driven, the controller is configured to execute invalid control through which the operation signal output from the second operator is not accepted.

Supplementary note (10): A beauty device includes a head having a stirring mechanism configured to stir bubbles; a bubble generation mechanism configured to generate and supply bubbles to the head; a drive source configured to drive the stirring mechanism and the bubble generation mechanism; a warming mechanism configured to output heat; a first operator configured to switch the drive source between a turn-on state and a turn-off state; a second operator configured to switch the warming mechanism between a turn-on state and a turn-off state; and a controller configured to control the drive source and the warming mechanism according to an operation signal output from the first operator and the second operator. When the warming mechanism is driven, the controller is configured to execute invalid control through which the operation signal output from the first operator is not accepted.

As described above, the beauty device, the head of the beauty device, the body of the beauty device in this disclosure can be applied to various beauty devices including a home beauty device and a commercial beauty device.

What is claimed is:

1. A head of a beauty device comprising:

a stirring mechanism configured to stir bubbles; and a head case provided with an opening for allowing the bubbles stirred by the stirring mechanism to pass through, wherein the head case includes a support portion configured to support the stirring mechanism in such a way that the stirring mechanism is capable of making at least one motion of a rotation and a movement relative to the head case, wherein the support portion supports the stirring mechanism in such a way that the stirring mechanism is capable of rotating relative to the head case, and wherein the stirring mechanism includes a base provided with a discharge port through which a mixture of a foaming agent and water passes, and a blade formed on a surface of the base which is an opening-side surface.

2. The head of a beauty device according to claim 1, wherein the head case includes a limiting portion configured to limit the position of the stirring mechanism in such a way that the stirring mechanism is not allowed to protrude out of the opening.

3. The head of a beauty device according to claim 1, wherein the discharge port is formed in a center portion of the base, and wherein a plurality of the blades are formed in a radial pattern around the discharge port.

4. The head of a beauty device according to claim 1, wherein a return port is formed in an outer circumferential portion of the base, and passes through the stirring mechanism.

5. The head of a beauty device according to claim 1, wherein the support portion supports the stirring mechanism in such a way that the stirring mechanism is capable of moving relative to the head case in a direction of approaching the opening and another direction of moving away from the opening.

6. The head of a beauty device according to claim 5, further comprising:

an elastic member configured to press the stirring mechanism in the direction of moving the stirring mechanism away from the opening.

7. A beauty device comprising:

the head according to claim 1; and a body including a head mount unit which the head can be attached to and detached from, and a drive source configured to output a drive force for driving the head.

8. A body of a beauty device comprising:

a head mount unit from which a first head, which includes a stirring mechanism configured to stir bubbles and a head case provided with an opening for allowing the bubbles stirred by the stirring mechanism to pass through, or a second head having a structure different from that of the first head can be attached to and detached;

a drive source configured to apply torque to the first head or the second head;

a first transmission mechanism configured to transmit torque to the first head; and a second transmission mechanism configured to transmit torque to the second head, wherein a rotational speed transmitted to the first head by the first transmission mechanism is higher than a rotation speed transmitted to the second head by the second transmission mechanism.

* * * * *